US005950243A

United States Patent [19]

Winters et al.

[11] Patent Number: 5,950,243

[45] Date of Patent: Sep. 14, 1999

[54] STRUCTURAL SHELL FOR PROTECTIVE HEADGEAR

[75] Inventors: William Robert Winters; Ray Fan, both of Edmonton, Canada; William Ostertag, 1905 Forest Drive, Cold Lake, Alberta, Canada, T0A 0V4; Surindar Pal Singh, Edmonton, Canada

[73] Assignees: Alberta Research Council, Edmonton; William Ostertag, Cold Lake, both of Canada

[21] Appl. No.: 08/876,197

[22] Filed: Jun. 16, 1997

[51] Int. Cl.[6] ..... A42B 3/06

[52] U.S. Cl. ..... 2/411; 2/412; 2/413

[58] Field of Search ..... 2/410, 411, 412, 2/413, 414, 425

[56] References Cited

U.S. PATENT DOCUMENTS

| | | | |
|---|---|---|---|
| Re. 29,742 | 8/1978 | Tung | 2/412 |
| 399,220 | 12/1889 | Keltner | 2/413 |
| 2,618,780 | 11/1952 | Cushman | 2/413 |
| 2,664,567 | 1/1954 | Nichols | 2/413 |
| 3,350,718 | 11/1967 | Webb | 2/410 |
| 3,447,163 | 6/1969 | Bothwell et al. | 2/412 |
| 3,462,763 | 8/1969 | Schneider et al. | 2/413 |
| 3,787,893 | 1/1974 | Larcher | 2/413 |
| 3,806,950 | 4/1974 | Spencer-Foote | 2/413 |
| 3,849,801 | 11/1974 | Holt et al. | 2/413 |
| 3,872,511 | 3/1975 | Nichols | 2/413 |
| 4,124,904 | 11/1978 | Matthes | 2/413 |
| 4,209,858 | 7/1980 | Coenen | 2/412 |
| 4,663,785 | 5/1987 | Comparetto | 2/413 |
| 5,129,107 | 7/1992 | Lorenzo | 2/413 |
| 5,263,203 | 11/1993 | Kraemer et al. | 2/413 |

*Primary Examiner*—Michael A. Neas
*Attorney, Agent, or Firm*—Davis and Bujold

[57] ABSTRACT

A structural shell for protective headgear includes a shell-form body composed of a plurality of cells. This structural shell can withstand loads much greater than conventional single walled structural shells, without buckling.

10 Claims, 4 Drawing Sheets

STRUCTURAL SHELL FOR PROTECTIVE HEADGEAR

FIELD OF THE INVENTION

The present invention relates to a structural shell for protective headgear, such as is worn by constructions workers and sports players such as cyclists, hockey players, football players and the like.

BACKGROUND OF THE INVENTION

Protective headgear have impact resistant structural shells. These structural shells each have a critical load threshold. An incremental increase in load above the critical load threshold results in a buckling of the structural shell. This buckling decelerates the force of a blow over a time interval, thus decreasing the impact energy of the blow. The critical load threshold relates primarily to the structure of the structural shell, as the critical load threshold is, typically, below the yield or fracture strength of the material. The ability of protective headgear to withstand a given impact without buckling is, of course, dependent upon the critical load threshold of the structural shell. Corrugations have been used to increase the critical load threshold of the structural shell. The structural shells have been used in combination with foam inserts, which crush under impact conditions to further decrease the impact energy of the blow.

SUMMARY OF THE INVENTION

What is required is a structural shell for protective headgear having an increased critical load threshold.

According to the present invention there is provided a structural shell for protective headgear which includes a shell-form body composed of a plurality of cells.

As will hereinafter be further described, a structural shell fabricated out of a plurality of cells has a substantially increased critical load threshold.

BRIEF DESCRIPTION OF THE DRAWINGS

These and other features of the invention will become more apparent from the following description in which reference is made to the appended drawings, wherein.

DETAILED DESCRIPTION OF THE PREFERRED EMBODIMENT

The preferred embodiment, a structural shell for protective headgear will now be described with reference to FIGS. 1 through 4.

Figure 1:
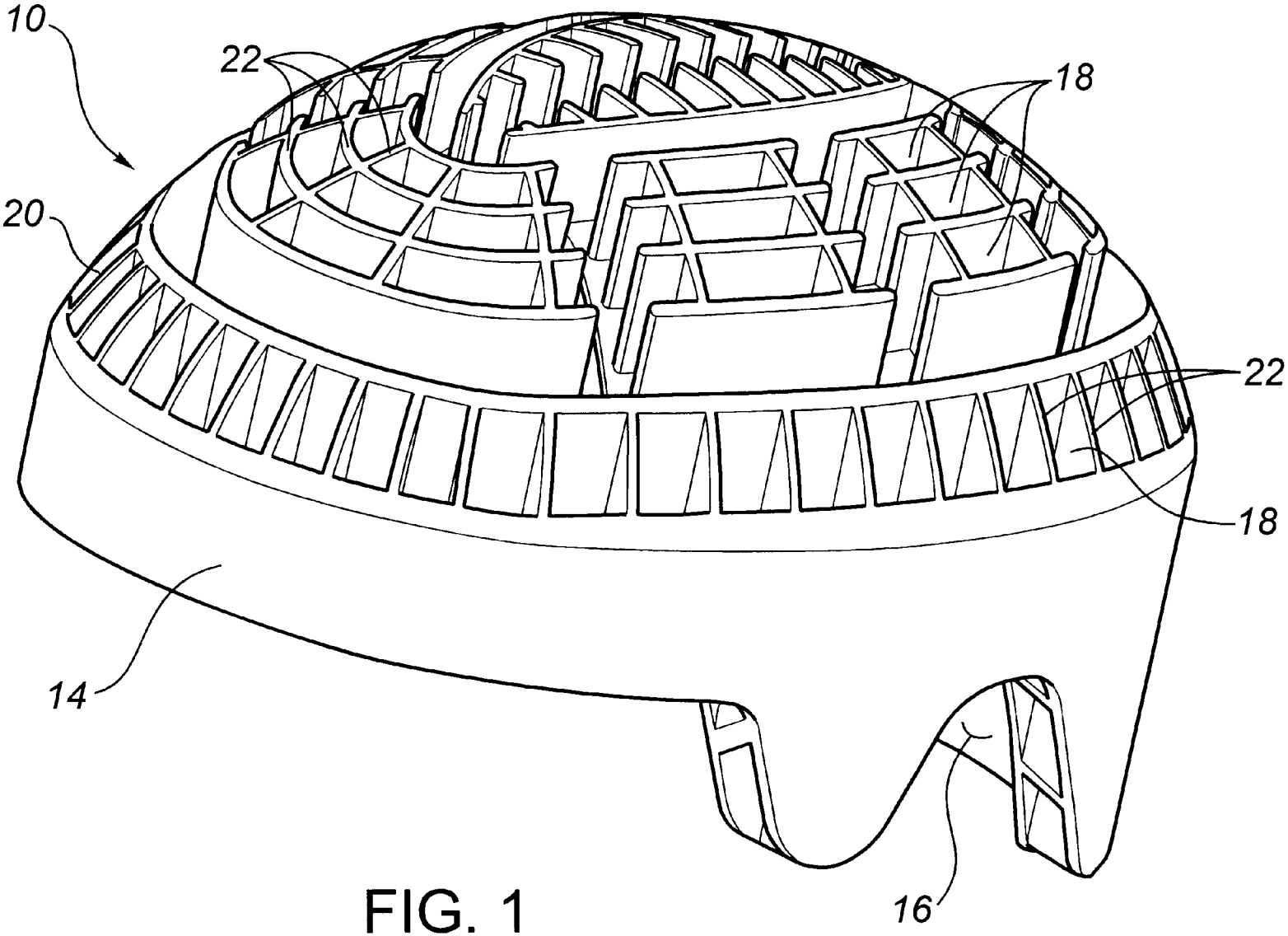
FIG. 1 is a perspective view of a first embodiment of structural shell for protective headgear constructed in accordance with the teachings of the present invention.
Figure 2:
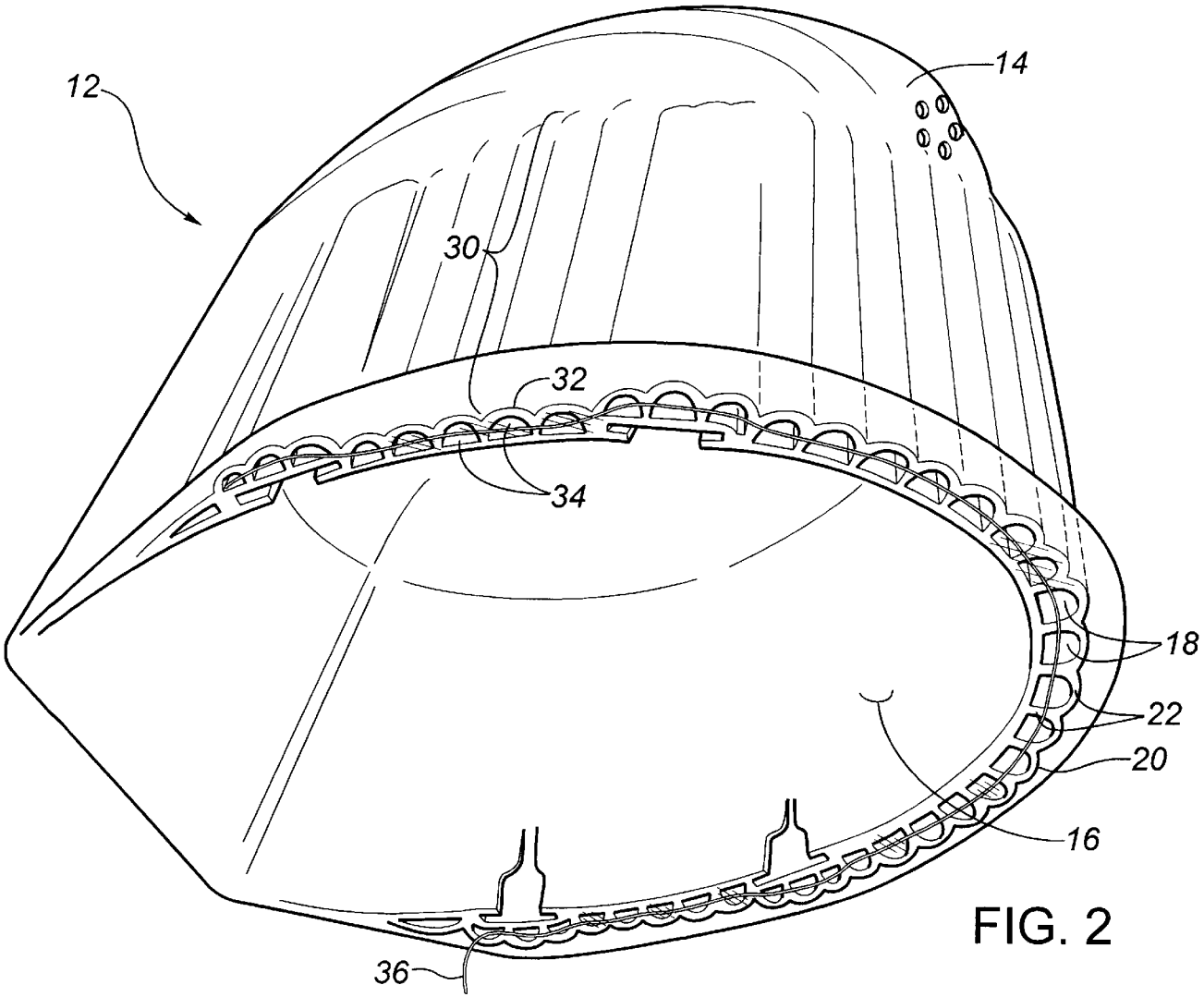
FIG. 2 is a bottom perspective view of a second embodiment of structural shell for protective headgear constructed in accordance with the teachings of the present invention.
Figure 3:
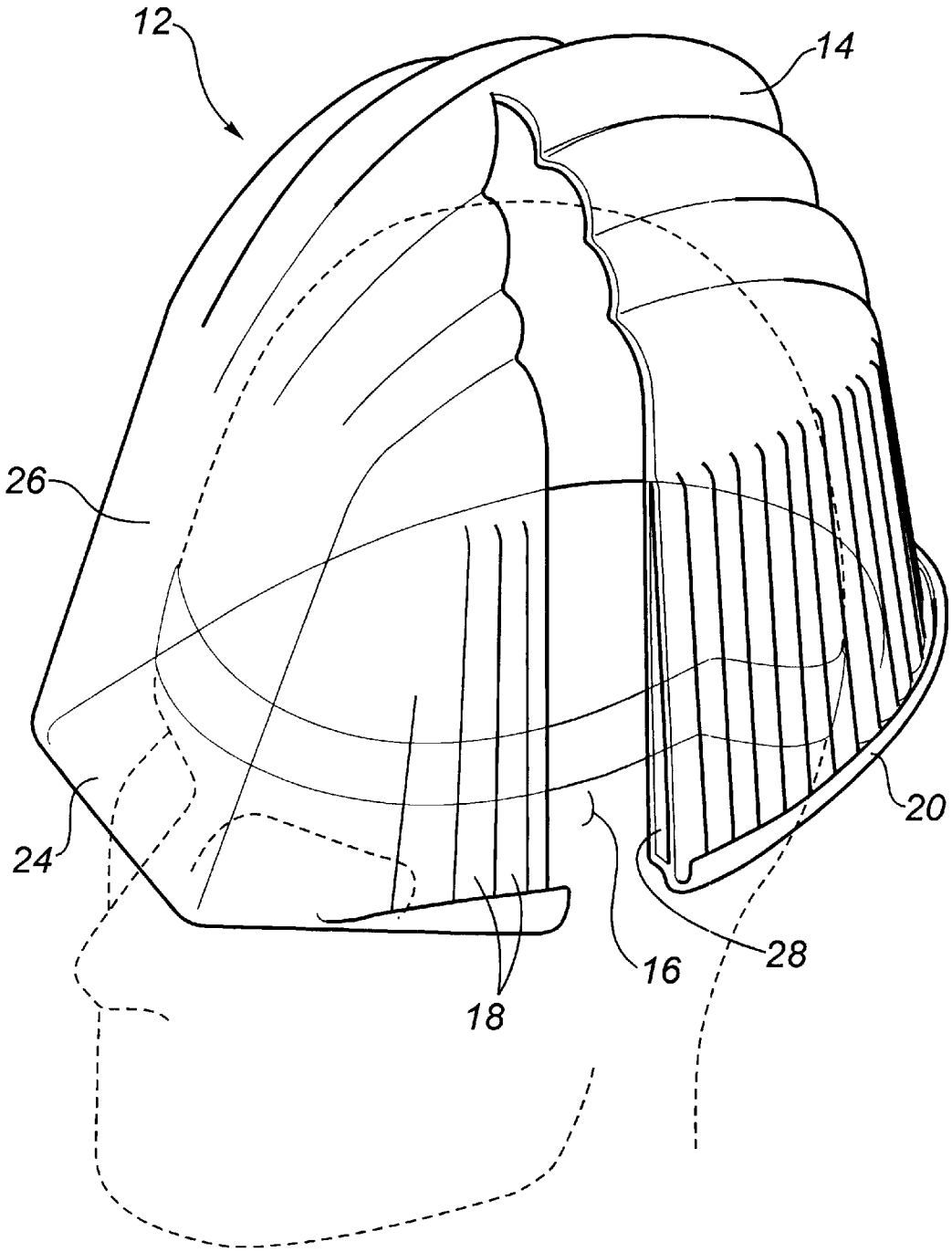
FIG. 3 is a top perspective view, partially cut away, of the structural shell for protective headgear illustrated in FIG. 2.
Figure 4:
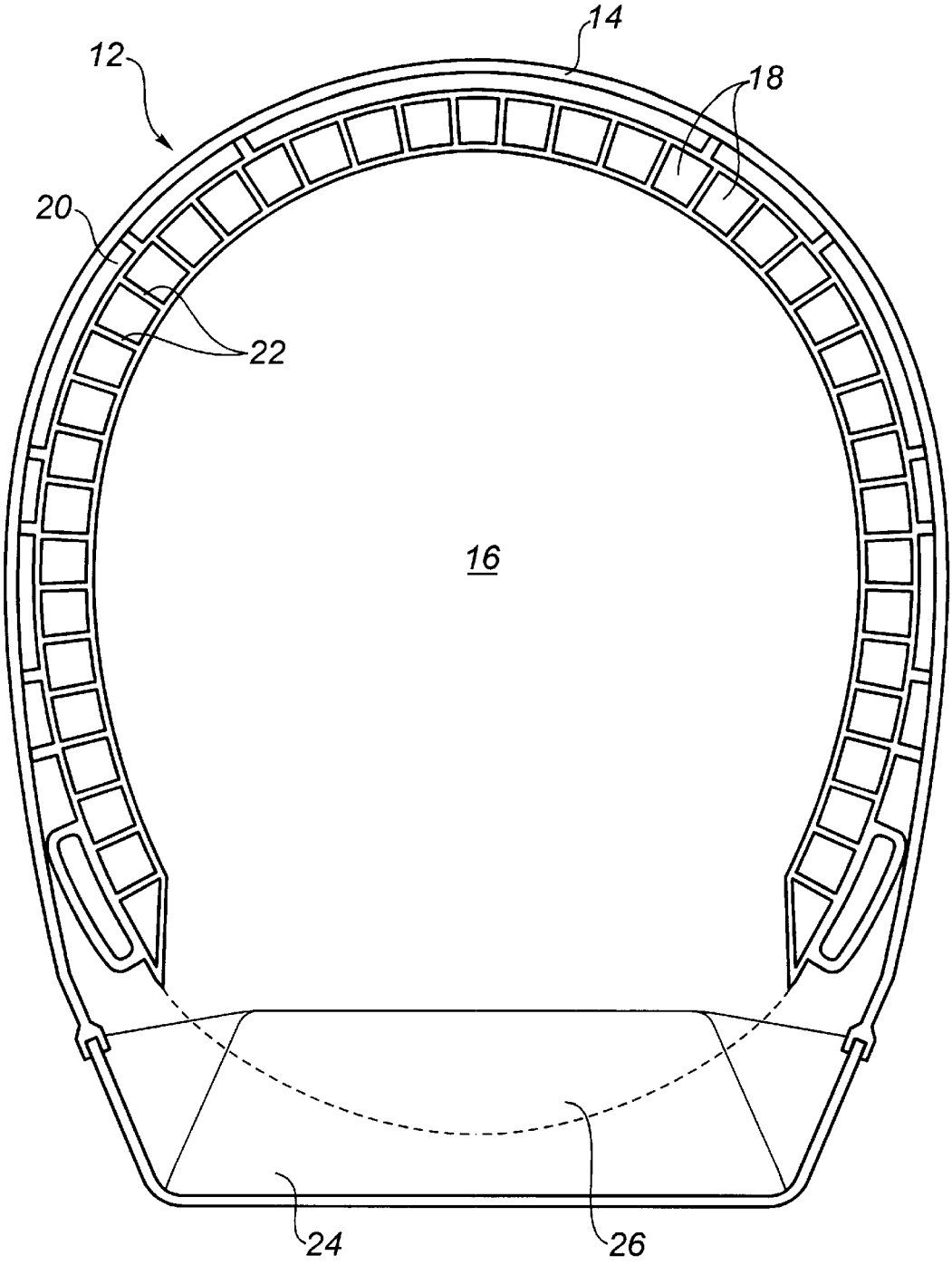
FIG. 4 is a bottom plan view of the structural shell for protective headgear illustrated in FIG. 2.

Referring to FIGS. 1 through 4 there are two versions of protective headgear constructed in accordance with the teachings of the present invention. A cyclist helmet 10 is illustrated in FIG. 1. A construction hard hat 12 is illustrated in FIGS. 2 through 4.

Referring to FIG. 1, cyclist helmet 10 illustrates the underlying principles of the invention relating to structural shells for protective headgear. Cyclist helmet 10 has a shell-form body 14 having a head receiving cavity 16. Shell-form body 14 is composed, at least in part, from a plurality of cells 18 around a substantial portion of a perimeter 20 of head receiving cavity 16. A majority of cells 18 are integrally connected by means of shared defining walls 22 between adjacent cells 18 around a substantial portion of perimeter 20.

The ability of the protective headgear to withstand a given impact without buckling is dependent upon the design of the cells and the material used. When an impact occurs that is sufficient to buckle defining walls 22 of cells 18, this buckling serves to decelerate the mass over time interval, thus decreasing the impact energy of the mass. This results in improved impact protection, especially for lateral impact.

In testing to prove the inventive concept the following results were obtained:

EXAMPLE 1

A single walled 0.100 inch thick structural shell was subjected to load. The critical load threshold at which buckling occurred was 17 pounds.

EXAMPLE 2

A first version partitioned into cells was subject to load. This example had a (support) wall thickness of 0.050 inches, a distance between the walls of 0.50 inches and a partition wall thickness of 0.03 inches. The critical load threshold at which buckling occurred was 207 pounds.

EXAMPLE 3

A second version partitioned into cells was subject to load. This example had a (support) wall thickness of 0.050 inches, a distance between the walls of 0.25 inches and a partition wall thickness of 0.03 inches. The critical load threshold at which buckling occurred was 205 pounds.

EXAMPLE 4

A third version partitioned into cells was subject to load. This example had a (support) wall thickness of 0.030 inches, a distance between the walls of 0.25 inches and a partition wall thickness of 0.03 inches. The critical load threshold at which buckling occurred was 66 pounds.

Structural shells described above are fabricated using conventional injection moulding processes. Thermoplastic in a molten state is conveyed by a reciprocating screw. The screw injects a predetermined amount of material under high pressure into a split cavity mould. The mould is kept cooler than the solidification temperature of the plastic material, so that the molten plastic freezes in the cavity. The mould is kept closed by a clamping pressure, typically in the area of 500 tons, to counter the injection pressure of 15,000 to 30,000 p.s.i.. After solidification the mould is opened and the headgear is ejected.

Once the teaching of the invention is understood, of strengthening the structural shell through the use of cells, the appearance and construction details of the structural shell can accommodate a wide variation in styles of protective headgear. In addition, various functional enhancements can be added to the underlying inventive concept. Referring to FIGS. 2 through 4, construction hard hat 12 has incorporated in it a number of refinements. The underlying mode of construction is similar to that employed with cyclist helmet 10. Hard hat 12 also has a shell-form body 14 with a head receiving cavity 16. Shell-form body 14 is composed, at least in part, from a plurality of cells 18 around a substantial portion of a perimeter 20 of head receiving cavity 16. A majority of cells 18 are integrally connected by means of shared defining walls 22.

The added features in hard hat 12 include an integrally formed photosensitive visor 24 and a photosensitive crown 26. With conventional hard hats, the visor and crown portions of the hard hat are made from opaque material. Since the user is unable to see through this opaque material, a significant vision loss is experienced in the upper field of view. A worker using such an opaque hard hat can easily strike his head by running into an unobserved low hanging overhead object in the workplace. With a see through visor, the worker can take necessary evasive action to avoid low hanging overhead objects. It is preferred that the see through visor be photosensitive, to provide some protection against vision loss from glare.

The added features in hard hat 12 also include closed cells filled with a medium 28 having shock dampening properties. The medium employed can be a solid such as foam, a gel, a liquid or a gas. Beneficial results may be obtained through the use of a fluid medium. The medium selected and the quantity of medium used has a practical weight limitation. It is, of course, undesirable to have hard hat 12 so heavy that it is uncomfortable and cumbersome to wear. Once the teaching of having cells 18 filled with medium 28 is understood, a multitude of further innovations relating to the utility of the medium are possible. The structural shell can be transparent with the shell deriving its coloration from the colour of medium 28 within cells 18. Defining walls 22 of cells 18 can be defined by semi-permeable membranes, and medium 28 selected to change colour when exposed to harmful gases. Where medium 28 is a fluid medium, cells 18 can be engineered to release fluid upon impact. In addition, where medium 28 is a fluid, means can be provided to have a controlled release of medium 28. Referring to FIG. 2, cells 18 are illustrated as being elongate chambers 30 which contain fluid medium 28. At a remote end 32 of each of elongate chambers 30 there is positioned a seal membrane 34. A pull string 36 is secured across each of seal membranes 34. By pulling upon pull string 36, the wearer of hard hat 12 may selectively release medium 28. When medium 28 is a fluid, such fluid may be selected for properties which protect human skin, such as non-toxic fire retardants or antiseptic fluids. In some applications, such as fire fighting, it may also be desirable to have seal membrane 34 made of wax, that would melt automatically to release non-toxic fire retardants upon being exposed to heat above a preset temperature for more than a preset period. It is also possible for cells 18 to contain a first reactive fluid and a second reactive fluid which, when intermixed, as a result of an internal rupturing of defining walls 22 of cells 18 generate a cushioning gas.

The word "cell" used in this application is intended to encompass the discrete elements of any structure that has a plurality of partially enclosed or fully enclosed compartments or spaces analogous to a honeycomb. Each cell has collapsible shock absorbing defining walls 22. They may or may not be filled with medium 28.

It will be apparent to one skilled in the art that modifications may be made to the illustrated embodiment without departing from the spirit and scope of the invention as hereinafter defined in the claims.

The embodiments of the invention in which an exclusive property or privilege is claimed are defined as follows:

1. A structural shell for protective headgear, comprising:

a shell-form body having a head receiving cavity, the body being composed, at least in part, from a plurality of structural integrally interconnected cells around a substantial portion of a perimeter of the head receiving cavity, the cells having defining walls which defining walls provide a shock absorbing capability to the shell-form body derived from buckling of the defining walls;

the cells having a critical load threshold defined by a critical material yield strength of the defining walls wherein a force applied to the shell exceeding the critical load threshold causes buckling of the defining walls; and wherein the defining walls rise at least one support wall and at least one partition wall, the at least one partition wall having a thickness less than that of the support wall.

2. The structural shell for protective headgear as defined in claim 1, wherein the cells are filled with a medium.

3. The structural shell for protective headgear as defined in claim 2, wherein the medium is a fluid.

4. The structural shell for protective headgear as defined in claim 3, wherein some of the plurality of cells have seal membranes that maintain the fluid within the cells and manual release means are provided to dislodge the seal membranes and thereby release of the fluid.

5. The structural shell for protective headgear as defined in claim 1, wherein the body has an integrally formed see through visor.

6. The structural shell for protective headgear as defined in claim 5, wherein the visor is photosensitive.

7. The structural shell for protective headgear as defined in claim 1, wherein the body has a photosensitive crown.

8. The structural shell for protective headgear as defined in claim 1, wherein the shell-form body is formed of a thermoplastic material.

9. A structural shell for protective headgear, comprising:

a shell-form body, the body having a head receiving cavity composed of a plurality of structural integrally interconnected cells around a substantial portion of a perimeter of the head receiving cavity, the cells having defining walls, which defining walls provide a shock absorbing capability to the shell-form body derived from buckling of the defining walls of the cells;

the cells having a critical load threshold defined by a critical material yield strength of the defining walls wherein a force applied to the shell exceeding the critical load threshold causes buckling of the defining walls; and each of the plurality of cells being filled with a fluid medium and having a seal membrane that maintains the fluid medium within the cells; and wherein the seal membrane is wax, such that the wax melts when exposed to heat thereby releasing the fluid medium from within the cells.

10. A structural shell for protective headgear, comprising:

a shell-form body, the body having a head receiving cavity composed of a plurality of structural integrally interconnected cells around a substantial portion of a perimeter of the head receiving cavity, the cells having defining walls, which defining walls provide a shock absorbing capability to the shell-form body derived from buckling of the defining walls of the cells;

the cells having a critical load threshold defined by a critical material yield strength of the defining walls wherein force applied to the shell exceeding the critical load threshold causes buckling of the defining walls;

each of the plurality of cells being filled with a fluid medium and having a seal membrane that maintains the fluid medium within the cells:

at least one pull string being provided to dislodge the seal membranes and thereby release the fluid medium form within the cells.

* * * * *